US006352268B1

(12) United States Patent
Peart

(10) Patent No.: US 6,352,268 B1
(45) Date of Patent: Mar. 5, 2002

(54) SNOWBOARD WITH TRANSITIONING CONVEX/CONCAVE CURVATURE

(76) Inventor: Stephen Peart, 21116 Locust Dr., Los Gatos, CA (US) 95031

( * ) Notice: Subject to any disclaimer, the term of this patent is extended or adjusted under 35 U.S.C. 154(b) by 0 days.

(21) Appl. No.: 08/797,776

(22) Filed: Feb. 7, 1997

Related U.S. Application Data

(63) Continuation-in-part of application No. 08/308,293, filed on Sep. 19, 1994.

(51) Int. Cl.[7] ..... A63C 5/044
(52) U.S. Cl. ..... 280/14.21; 280/600; 280/609
(58) Field of Search ..... 280/602, 608, 280/609, 610, 28.14, 600, 14.21, 14.22; 441/68, 74

(56) References Cited

U.S. PATENT DOCUMENTS

| | | | | |
|---|---|---|---|---|
| 1,858,120 A | | 5/1932 | Stevens | |
| 2,065,179 A | | 12/1936 | Fosse | |
| 2,531,946 A | | 11/1950 | Parker | |
| 3,173,161 A | | 3/1965 | Amsbry | |
| 3,289,227 A | * | 12/1966 | Kelly, Jr. | 441/74 |
| D207,612 S | | 5/1967 | Crabb | |
| 3,414,919 A | | 12/1968 | Gust | |
| 3,437,345 A | | 4/1969 | Berta | |
| 3,834,250 A | | 9/1974 | Fonas | 76/101 R |
| 3,918,114 A | * | 11/1975 | Schmitt | 441/68 |
| 4,049,760 A | | 9/1977 | Lozach | 264/51 |
| 4,083,577 A | * | 4/1978 | Ford | 280/608 |
| RE29,659 E | * | 6/1978 | Bildner | 280/608 |
| 4,097,061 A | | 6/1978 | Dietlein | 280/607 |
| 4,165,091 A | | 8/1979 | Chadwick | |
| 4,351,911 A | | 9/1982 | Fox | 521/138 |
| 4,353,853 A | | 10/1982 | Swift | 264/41 |
| 4,399,085 A | | 8/1983 | Belbin et al. | 264/41 |
| 4,405,139 A | | 9/1983 | Kawahard | |
| 4,433,855 A | * | 2/1984 | Wyke | 280/609 |
| 4,479,998 A | | 10/1984 | Belbin et al. | 428/220 |
| 4,592,567 A | | 6/1986 | Sartor | 280/602 |
| 4,713,032 A | | 12/1987 | Frank | 441/74 |
| 4,721,020 A | | 1/1988 | Stumpf | 76/83 |
| 4,766,031 A | | 8/1988 | Kohl | 428/317.9 |
| 4,778,710 A | | 10/1988 | Deutsch | 428/192 |
| 4,798,549 A | | 1/1989 | Hirsch | 441/74 |
| 4,818,839 A | | 4/1989 | Chastain | 219/76.14 |
| 4,836,814 A | | 6/1989 | Bambara et al. | 441/65 |
| 4,838,571 A | | 6/1989 | Sevington | 280/608 |
| 4,850,252 A | | 7/1989 | Sewell | 76/83 |
| 4,850,913 A | | 7/1989 | Szabad, Jr. | 441/65 |

(List continued on next page.)

FOREIGN PATENT DOCUMENTS

| | | | |
|---|---|---|---|
| AT | 170377 | 7/1951 | |
| AT | 214326 | 3/1961 | |
| CA | 746385 | 11/1966 | |
| DE | 1921 589 | 11/1970 | |
| DE | 27 49 027 | 3/1979 | |
| DE | 35 37 703 C1 | 5/1987 | |
| DE | 39 34 888 A1 | 5/1990 | |
| JP | 5-161736 | 6/1993 | |
| NO | 80939 | 10/1952 | |
| SU | 1516136 | * 10/1989 | 280/602 |

*Primary Examiner*—Frank Vanaman
(74) *Attorney, Agent, or Firm*—Kolisch Hartwell Dickinson McCormack & Heuser

(57) ABSTRACT

An elongate snowboard having a body which is characterized by a central region which, in transverse cross section is convex in relation to the way it faces a snow surface, first and second end regions each joining with opposite ends of the elongate central region and each of which, in transverse cross section is concave in relation to the way that it faces a snow surface, with the central and end regions collectively being characterized, as one looks at either broad face of the snowboard, by bilateral symmetry relative to both the central longitudinal axis of the board and to the central transverse axis thereof.

4 Claims, 1 Drawing Sheet

U.S. PATENT DOCUMENTS

| | | | | | |
|---|---|---|---|---|---|
| 4,884,343 | A | | 12/1989 | Sewell | 30/169 |
| 4,895,388 | A | | 1/1990 | Richmond | 280/609 |
| 4,897,063 | A | | 1/1990 | Scheurer et al. | 441/68 |
| 4,915,440 | A | | 4/1990 | Chambers | 280/14.2 |
| D308,711 | S | | 6/1990 | Katz | D21/229 |
| D308,996 | S | | 7/1990 | Katz | D21/229 |
| 4,940,629 | A | | 7/1990 | Weber et al. | 428/213 |
| 4,951,960 | A | | 8/1990 | Sadler | |
| 4,974,868 | A | | 12/1990 | Morris | 280/609 |
| 5,019,450 | A | | 5/1991 | Cogswell et al. | 428/402 |
| 5,032,096 | A | | 7/1991 | Scott et al. | 441/74 |
| 5,044,656 | A | | 9/1991 | Peyre | 280/618 |
| 5,092,618 | A | | 3/1992 | Mayr | 280/602 |
| 5,135,249 | A | | 8/1992 | Morris | 280/609 |
| 5,203,583 | A | * | 4/1993 | LeGrand et al. | 280/602 |
| 5,213,889 | A | | 5/1993 | Cogswell et al. | 428/332 |
| 5,301,965 | A | * | 4/1994 | Floreani | 280/600 |
| 5,320,378 | A | | 6/1994 | Wiig | 280/610 |
| 5,356,159 | A | * | 10/1994 | Butterfield | 280/14.22 |
| 5,462,304 | A | | 10/1995 | Nyman | 280/609 |
| 5,695,209 | A | * | 12/1997 | Deborde et al. | 280/602 |
| 5,769,445 | A | * | 6/1998 | Morrow | 280/14.21 |
| 5,924,718 | A | * | 7/1999 | Gordon et al. | 280/610 |
| 6,062,585 | A | * | 5/2000 | Hess | 280/608 |

* cited by examiner

SNOWBOARD WITH TRANSITIONING CONVEX/CONCAVE CURVATURE

CROSS-REFERENCES TO RELATED APPLICATIONS, AND SELECTED INCORPORATIONS BY REFERENCE

This application is a continuation-in-part of my co-pending U.S. patent application, Ser. No. 08/308,293, filed Sep. 19, 1994 for INJECTION MOLDED FOAMED COMPOSITE MATERIAL SNOWBOARD, and also of my co-pending U.S. patent application, Ser. No. 08/796,046, filed , Feb. 7, 1997, for SNOWWBOARD HAVING MOLDED, COMPOSITE-MATERIAL BODY JOINED TO BODY-CAPTURED LATERAL EDGE STRUCTURES. The latter-mentioned filing date is the same as the filing date for the present application.

The snowboard of the present invention is formed with a composite-material body which is produced essentially in accordance with the teachings of the above-referred-to '293 co-pending patent application, and with body-captured edges in accordance with the teachings of the other, above-referred-to, co-pending patent application, and certain portions of the specification texts in these two referenced applications are repeated below in the present specification. Additionally, the snowboard disclosed herein may employ edges which are selectively tunable in accordance with the teachings of my existing U.S. Pat. No. 5,538,272, issued Jul. 23, 1996, for TUNABLE SNOWBOARD.

The entireties of the disclosures contained in the two above-mentioned co-pending patent applications, and in the single mentioned patent, are hereby incorporated by reference into this disclosure.

BACKGROUND AND SUMMARY OF THE INVENTION

This invention relates to a snowboard, and more particularly to a snowboard which is characterized by special compound curvilinearity which features transitioning (along the length of the board) between concave and convex curvature in relation to that expanse of the board which faces a snow surface.

Recreational/sporting snowboards have, in recent years, acquired extraordinary and seemingly ever-growing popularity in the arena of snow sporting activities. Developments in this area on which I have worked, and with regard to which I have made and contributed several important advances, have related to snowboard structures (and associated features) which depart, structurally, from conventional layered/laminated-wood snowboard structures. In particular, my recent prior snowboard work has shifted attention toward snowboards that are functionally competitive with, yet significantly advanced with respect to, laminated structures, which advanced boards are formed of a composite-material body created by hot-flow injection molding of a blend containing a plastic mass, a foaming agent, and reinforcing fibers, such as carbon or glass fibers. The several advances for which I have been responsible are illustrated and described in the above-referred-to, still co-pending U.S. patent applications, and in the above-identified existing U.S. patent.

In addition to retaining the well-recognized, consumer-desired characteristics of size, resilience, "feel", weight and topographical configuration (including fairly sophisticated shaping and curvilinearity) of conventional laminated-wood snowboards, my composite-material developments offer advances and enhancements in performance, durability, ease and simplicity of manufacture, and other things not available in and regarding the best-known conventional laminated boards.

The snowboard described and claimed herein, which forms the essence and core of the present invention, and as will be explained below, (a) utilizes the composite-material body structure described in relation to my prior work, (b) preferably employs edge structures configured and joined in place also in accordance with my recent prior work, and (c) launches, from that base of prior work, a special topographical board configuration involving longitudinally transitioning concave and convex curvatures in that face of the board which is intended to be the snow-surface contacting face. This complex, compound curvilinearity is achieved readily in a snowboard body which is injection molded in accordance with my prior work, and its specific features, which are described hereinbelow, offer very special and unique user-action maneuverability which renders the new snowboard construction described herein peerless, in a performance sense, from others available in the field.

In particular, the snowboard of the present invention is formed with an elongate body having a snow-contacting facial expanse that is characterized by a longitudinal central region which, in transverse cross section, is convex, with this central region joining with a pair of opposite end regions which, in transverse cross section, are concave. The topography of this board, as viewed from either face, is, essentially, bilaterally symmetrical, both with respect to the board's longitudinal axis, and with respect to the board's central transverse axis, and as viewed from either long side, is likewise seen as having bilateral symmetry relative to its central transverse axis.

Molded into and extending along opposite longitudinal sides of the board's body are metallic edges, which may or may not be tunable edges, and which co-act with the new topography proposed by this invention to achieve remarkable snow-action performance.

Mentioning very briefly what can and does occur functionally as a result of the "transitioning" topography just mentioned, the convexity present in the central portion of the board, with a user properly positioned essentially for straight, in-line travel, tends to present and act somewhat like an elongate, straight "keel" in contact with a snow surface, thus to enhance stable, straight-line travel. The concavity mentioned for both opposite ends of the board offers a structure which generally can be characterized as possessing laterally spaced, downwardly directed "rails" which, on the occurrence of a user weight shift, dramatically initiate the carving, defining and controlling of a turn. The lateral sides or edges of the central portion also carve into a snow surface to play a "turning" role.

Various other features and advantages which are offered by the present invention will become more fully apparent as the description which now follows is read in conjunction with the accompanying drawings.

DETAILED DESCRIPTION OF THE INVENTION

Figures 1, 2, 3, 4, 5, 6:
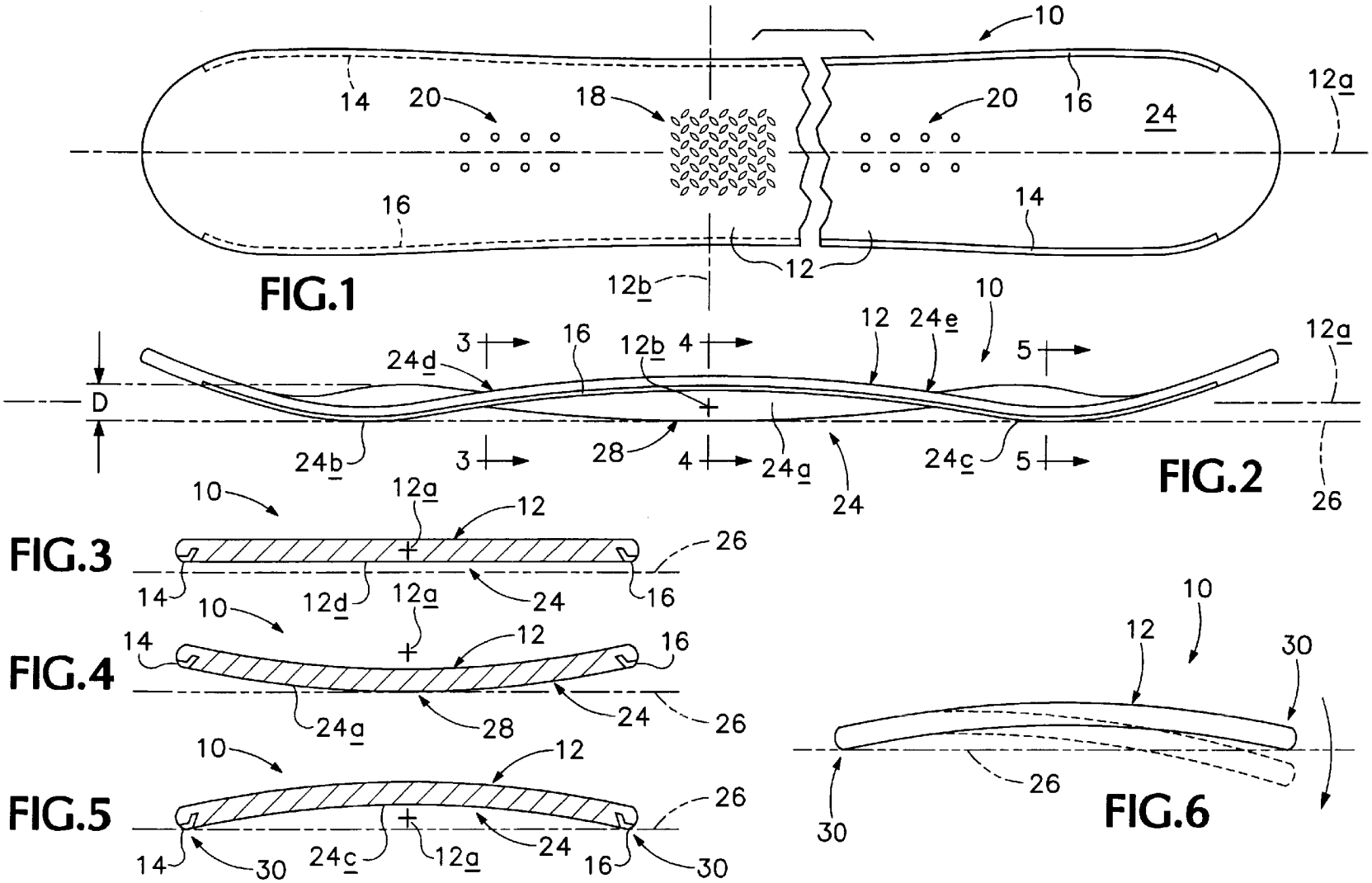
FIG. 1 is a plan view of a snowboard constructed in accordance with the present invention, with this view being fragmented in the area embraced by a bracket in such a manner that what is shown on the left side of the fracture in FIG. 1 is a plan view of the upper side of the board, and that what is shown on the right side of the fracture illustrates the bottom, snow-contacting face in the board. Despite the fact that a fracture is illustrated in FIG. 1, the board pictured therein is illustrated in proper longitudinal and lateral proportion relative to its longitudinal and to its central transverse axes.
FIG. 2 is a side elevation of the board of FIG. 1, with the lower snow-contacting side of the board facing downwardly and shown resting in idealized way on a horizontal snow surface, and with longitudinally, transitioning, convex/concave curvatures being highly exaggerated in order to be easily understood in the description of the snowboard which follows shortly.
FIGS. 3, 4 and 5 are isolated, transverse cross-sectional views taken generally along the lines 3—3, 4—4 and 5—5, respectively, in FIG. 2.
FIG. 6 is a view somewhat similar to that presented in FIG. 5, but missing cross-sectional cross hatching, and illustrating, in solid lines, the board in one condition of resting on a snow surface, and in dashed lines, in a slightly clockwise (in the figure) angulated or rotated condition to illustrate, as will be explained, the carving of a turn.

Turning attention now to FIGS. 1–5, inclusive, indicated generally at 10 is a snowboard which is constructed in accordance with the present invention. Board 10, as illustrated herein, is made up of three components, including an injection-molded, composite-material body 12, and a pair of elongate metal edges which are molded into place in the body, and which extend along major portions of the opposite sides of the body—these edges being indicated at 14, 16.

As was mentioned above in the description of the drawings, shown on the left side of the fracture lines in FIG. 1 is a top-surface view of board 10, and shown on the right side of the fracture lines in the figure is the bottom, snow-contacting side, or facial expanse, of the board. Thus, edges 14, 16 on the left side in FIG. 1 have positions that are reversed vis-à-vis of the positions shown for these edges on the right side of FIG. 1. Despite this situation, what might be thought of as the perimetral footprint of the board is accurately pictured in FIG. 1, in the sense that, despite the fracture lines, the board is seen to possess, in accordance with the invention, bilateral symmetry both with respect to its long, or longitudinal, axis 12*a*, and with respect to its central transverse axis 12*b*.

In FIG. 2, in which board 10 is not fragmented, one can see that, from the side-view point of view, and also in accordance with the invention, board 10 possesses bilateral symmetry with respect to central transverse axis 12*b*. Also, only edge 16 is visible in FIG. 2.

Formed during the molding process employed in the fabrication of snowboard 10 is a multi-island stomp pad shown generally at 18 in FIG. 1.

Prepared as by drilling after molding a body 12 are two groups (eight in each group) of through-bore holes illustrated generally at 20, 22, which hole groupings are employed for the securing of conventional foot-binding hardware, not shown.

As has been mentioned earlier herein, snowboard body 12, which is referred to as a "monocoque" body, is injection molded employing a composite blend including a plastic mass, a foaming agent, and reinforcing fibers. The presence of the foaming agent in this blend, during the injection molding process, results in the creation of an elongate snowboard body that ends up with a distributed, differentiated density—progressing from less dense near the central core toward more dense near substantially all outside regions in this body.

The plastic component of the composite body material may be either a thermoplastic or a thermoset material, but preferably is a thermoplastic material selected from the group consisting of nylon, polypropylene and polyethylene. From this group of materials, I have now experienced a great deal of manufacturing and performance success, in different applications, with polypropylene and also with nylon. Foaming of this material is accomplished through the conventional use of well-known and well-understood foaming agents which are present and introduced to the mass at the time of the hot-flow injection molding procedure. Foaming is accomplished preferably to diminish what would be the "full (unfoamed) mass" of the body, were it made of solid unfoamed material, to within a weight-reduction range of about 10% to about 50%. Thus, the foamed void space within the body preferably occupies an overall volume within this same range of about 10% to about 50% of the total volume of body 12. For a large number of the most desirable performance applications, a "weight reduction" of around 15% is preferable.

The strands of fiber material incorporated with the plastic mass in body 12 are formed of carbon, but could also be formed of fiberglass, with these strands typically having lengths that reside in the range of about 1/128-inch to about 1-inch, and with a diameter typical of such reinforcing strands. Reinforcing carbon fibers typically have a diameter in the range of about 7- to about 7.5-microns, and glass fibers typically have a diameter in the range of about 14- to about 15-microns. In a given construction, it is preferable that substantially all of the strands have essentially the same length, and a preferred length has been found to be about ½-inch. Within the weight-contribution range mentioned earlier for the strands in the composite molding mass, a preferred weight contribution for most applications has been found to be about 40% of the total weight of body 12.

The presence of the mentioned foaming agent results in a final board construction in which there exists a distribution of inside bubbles or void spaces which are relatively large and close together near core areas of the board and progressively smaller and more widely spread moving away from the core area toward outside molded surface regions—all of this resulting in a board whose density gradually rises from relatively undense in the core region toward significant more dense adjacent outside surface regions.

More discussion about the making and make up of board body 12 can be found in the above-referred-to '293 patent application.

Edges 14, 16 are prepared in relation to body 12 in accordance with the description and drawings found in the above-referred-to patent application covering SNOWBOARD HAVING MOLDED, COMPOSITE-MATERIAL BODY JOINED TO BODY-CAPTURED LATERAL EDGE STRUCTURES, and in the particular snowboard now being described, edges 14, 16, and their manners of joinder with body 12, are like those edges and joinder protocols illustrated, and described with respect to, FIGS. 1–4, inclusive, in this just-referred-to copending patent application. If desired, the edges which are employed in snowboard 10 may be formed to be "tunable" in accordance with the teachings of the above-referred-to '272 U.S. patent.

In any event, the edges in snowboard 10 are bound with and captured by the densest part of the material making up body 12, and are very securely "locked" in place.

The underside surface, shown generally at 24, in board 12 is also referred to herein, and it functions, as a snow-contacting facial expanse, and in FIGS. 2–5, inclusive, there is shown by dash-double-dot line 26 an idealized, substantially flat snow surface which this facial expanse faces.

Facial expanse 24 is formed, in general terms, with three continuously joined regions, including a longitudinal central region 24*a* which occupies approximately two-thirds of the overall length of the snowboard, and a pair of opposite end regions 24*b*, 24*c*, each of which occupies about one-sixth of the overall length of the snowboard. These relative occupational percentages can, of course, be varied if desired. Regions 24*a* and 24*b* are joined through a joinder region 24*d*, and regions 24*a* and 24*c* are joined through another joinder region 24*e*.

Seen clearly in FIGS. 2 and 4 is the fact that the longitudinal central region of facial expanse 24 is generally convex, and in FIGS. 2 and 5 (particularly for end region 24*c*), that the end regions are generally concave. It will be noted, on looking at FIGS. 2, 4 and 5, that what can be thought of as the maximum amount of convexity in central region 24*a* is about the same as what can also be thought of as the maximum amounts of concavity in end regions 24*b*, 24*c*. These characteristics of relative convexity and concavity can also be varied if so desired. Dimension D which is illustrated at the left side of FIG. 2 measures the vertical distance which exists between the upper surface "crest" of the concave end regions and the lower surface "crest" of the convex central region, and this dimension preferably lies within the range of about 4- to about 8-millimeters. Obviously, the convexity/concavity features of snowboard 10 are exaggerated in the drawings, and as has been mentioned, this has been done in order to promote descriptional clarity in this specification and in the drawings.

In FIGS. 2–5, inclusive, snowboard 10 is pictured in an idealized condition resting on a substantially flat (planar) snow surface 26 (illustrated with a dash-double-dot line). In this setting, the underside, longitudinal central region of the board 24*a* presents to the underlying snow surface what can be thought of herein as a longitudinally extending, laterally central keel, and such is indicated generally at 28 in FIGS. 1 and 4. As can be seen in FIGS. 2 and 3, joinder regions 24*d*, 24*e* are substantially straight or unbent in transverse cross section, and reside in positions spaced above snow surface 26 (shown in FIG. 3 for region 24*d*. With reference to FIGS. 2 and 5, and understanding that each of the end regions has the same nominal relationship with snow surface 26, end region 24*c* can be thought of a presenting, near its lateral opposite sides, a pair of downwardly extending, snow-engaging rails which are generally shown at 30 in FIG. 5 in the immediate vicinities of edges 14, 16.

Thus, in the condition illustrated in FIGS. 2–5, inclusive, the lateral edges of central portion 24*a* are out of contact with the snow surface, the lateral edges of the end regions are in contact with the snow surface, and the joinder regions are entirely out of contact with the snow surface. The central region presents only the keel structure mentioned as being in contact with snow surface 26.

Another way of expressing the longitudinally transitioning, concave-convex, complex curvilinearity which characterizes snowboard 10 is to describe, in relation to a supporting flat surface, such as snow surface 26, the path, or trace, followed by the perimetral edge of expanse 24, progressing along that edge from the center of one end of the board to the center of the other end, and along just one side of the board. Such a "trace", beginning centrally at one end of the board, follows a path which curves laterally downwardly and longitudinally from one elevation above the surface in a curving sweep which ends with a location in contact with the supporting surface, continuing therefrom in a central path which gradually rises from the surface and extends throughout a central portion of the snowboard toward another, lower elevation above the supporting surface, which central path then curves gradually downwardly toward another location in contact with the supporting surface, with the path then sweeping upwardly, curvilinearly and laterally inwardly toward termination at the opposite central extremity of the snowboard and at a raised elevation substantially matching the mentioned "one elevation" stated in the early part of this sentence.

The unique compound curvilinearity of snowboard 10 affords the user with a high degree of precision control and unparalleled maneuverability. With a user "riding" on the board and intending to accomplish straight-line travel, simply by maintaining weight in a laterally central position, the keel-like contact which exists between central region 24*a* and an underlying snow surface readily promotes this intention. By rocking one's body so as to shift weight toward one side or the other of the board, with emphasis placed forwardly and/or rearwardly of the board's central transverse axis, the rails described in the concave end portions (see particularly FIG. 6) dig rapidly into a snow surface to initiate, control, and promote very quick and definitive carving of a turn. The fact that such rail structures exist at both opposite ends of the board, and that a user can select to shift weight laterally toward one end or the other, or simultaneously toward both ends, offers a high degree of variable performance possibility. Naturally, and because the convexity and concavity features in the board are modest in relation to the overall length of the board, the lateral sides and edges of the central region also play roles in defining turns.

Injection-molding formation of the body in the board allows for easy production of desired convexity/concavity features. And, while a particular range has been described herein above, those skilled in the art will recognize that other "levels" of concavity and convexity can be introduced if so desired.

Accordingly, while a preferred embodiment of the invention has been described, it is appreciated that variations and modifications may be made without departing from the spirit of the invention.

It is desired to claim and secure by Letters Patent:

1. An elongate snowboard characterized by both longitudinal and transverse bilateral symmetry, and having a snow-contacting facial expanse which extends between opposite, matching tip regions adapted to rise above a flat snow surface which is contacted by the snowboard, said snowboard comprising a single longitudinal central region which, in transverse cross section, is convex, and a pair of spaced end regions adjacent said central region, each of which end regions, in transverse cross section, is concave from one lateral edge to an opposing lateral edge.

2. The snowboard of claim 1, wherein said central and end regions join through a pair of joinder regions which, in transverse cross section, are substantially straight.

3. An elongate snowboard comprising an elongate central portion having a snow-contacting expanse with lateral edges, and opposite end portions joined directly to said central portion and each having a snow-contacting expanse with lateral edges, said portions collectively having a central longitudinal and a central transverse axis, and collectively being characterized by bilateral symmetry relative to each of said two axes, and being constructed in such a manner that, with the snowboard in operative, unloaded contact with a flat snow surface, a single region only of said central portion resides in contact with the snow surface, and said edges in said central portion reside spaced in gentle arcs rising from the snow surface, and said edges in said end portions reside in contact with the snow surface.

4. The snowboard of claim 3, wherein said central portion, intermediate its opposite ends, and on its snow-contacting expanse is formed to accommodate selective user loading and rocking of the central portion laterally to urge a selected one of its edges into contact with such a snow surface.

* * * * *